US009447589B2

(12) United States Patent
Kometas

(10) Patent No.: US 9,447,589 B2
(45) Date of Patent: Sep. 20, 2016

(54) CROWN MOLDING FRAMING ASSEMBLY

(71) Applicant: Athas N. Kometas, Port Orange, FL (US)

(72) Inventor: Athas N. Kometas, Port Orange, FL (US)

( * ) Notice: Subject to any disclaimer, the term of this patent is extended or adjusted under 35 U.S.C. 154(b) by 0 days.

(21) Appl. No.: 14/801,320

(22) Filed: Jul. 16, 2015

(65) Prior Publication Data

US 2016/0017614 A1 Jan. 21, 2016

Related U.S. Application Data

(60) Provisional application No. 62/025,580, filed on Jul. 17, 2014.

(51) Int. Cl.
*E04F 19/04* (2006.01)

(52) U.S. Cl.
CPC ..... *E04F 19/0459* (2013.01); *E04F 19/0436* (2013.01); *E04F 19/0477* (2013.01)

(58) Field of Classification Search
CPC .. E04F 19/0459; E04F 19/0436; E04B 1/40; E04B 2001/405
USPC ..... 52/288.1, 287.1
See application file for complete search history.

(56) References Cited

U.S. PATENT DOCUMENTS

| | | | | | |
|---|---|---|---|---|---|
| 2,981,988 | A * | 5/1961 | Schweitzer | E04F 19/0436 | 52/288.1 |
| 3,473,278 | A * | 10/1969 | Gossen | E04F 19/0463 | 52/211 |
| 3,707,061 | A | 12/1972 | Collette et al. | | |
| 4,150,517 | A * | 4/1979 | Warner, Sr. | E04F 19/0436 | 52/288.1 |
| 4,709,522 | A * | 12/1987 | Carnahan | E04F 19/0436 | 52/288.1 |
| 5,001,877 | A * | 3/1991 | Edwards | B44C 5/00 | 403/295 |
| 5,179,811 | A | 1/1993 | Walker et al. | | |
| 5,359,817 | A | 11/1994 | Fulton | | |
| 5,433,048 | A | 7/1995 | Strasser | | |
| 5,463,835 | A | 11/1995 | Wood | | |
| 5,592,797 | A * | 1/1997 | Logan | E04F 19/0436 | 52/257 |
| 5,651,224 | A | 7/1997 | Brabant | | |
| 7,210,272 | B2 | 5/2007 | Friday | | |
| 7,926,232 | B2 | 4/2011 | de Raucourt | | |
| 2003/0115813 | A1* | 6/2003 | Wong Hahn | E04F 19/0436 | 52/288.1 |
| 2007/0039257 | A1* | 2/2007 | LeBlanc | E04D 13/15 | 52/211 |
| 2010/0050550 | A1 | 3/2010 | Estok | | |
| 2010/0242388 | A1* | 9/2010 | DePaul | E04F 19/0436 | 52/287.1 |
| 2010/0313498 | A1 | 12/2010 | Paidar et al. | | |
| 2013/0205697 | A1 | 8/2013 | Nickell | | |

FOREIGN PATENT DOCUMENTS

| | | |
|---|---|---|
| FR | 2367888 | 7/1979 |

* cited by examiner

*Primary Examiner* — Brian Glessner
*Assistant Examiner* — Paola Agudelo
(74) *Attorney, Agent, or Firm* — Allen Dyer Doppelt Milbrath & Gilchrist

(57) ABSTRACT

A framing assembly for crown molding includes a mounting bracket and a plurality of mounting blocks. The mounting bracket is elongated in a length direction and adapted for mounting in a construction joint with the length direction extending in parallel with the joint axis. The mounting blocks are connected to the mounting bracket and spaced apart in the length direction. The crown molding is secured in the joint via connection to the mounting blocks.

18 Claims, 5 Drawing Sheets

CROWN MOLDING FRAMING ASSEMBLY

CROSS-REFERENCE TO RELATED APPLICATION

This application claims the benefit of U.S. Provisional Patent Application Ser. No. 62/025,580, filed on Jul. 17, 2014, the contents of which application is herein incorporated by reference in their entirety.

FIELD OF THE INVENTION

The present invention relates to crown molding, and more particularly, to crown molding framing assemblies.

BACKGROUND OF THE INVENTION

Decorative trims, such as crown molding, are used to cover and decorate construction joints. Crown molding, in particular, is usually installed to a wall-ceiling joint by affixing it both to ceiling joists and to vertical wall studs. However, it is a time consuming process to find and locate both ceiling framing structures and wall framing structures, which will frequently not be aligned. In many cases, framing behind drywall or plaster on the ceiling side of the joint may be altogether absent, making the process even more cumbersome. While there are some products that have been advanced to facilitate the installation of crown molding and other decorative trim (see, e.g., U.S. Pat. No. 5,179,811 and U.S. Patent Publication No. 2010/0313498, the contents of which are herein incorporated by reference in their entirety), further improvements are possible.

SUMMARY OF THE INVENTION

In view of the foregoing, it is an object of the present invention to provide an improved crown molding framing assembly and related methods of making and use.

According to an embodiment of the present invention, a framing assembly for crown molding includes a mounting bracket and a plurality of mounting blocks. The mounting bracket is elongated in a length direction and adapted for mounting in a construction joint with the length direction extending in parallel with the joint axis. The mounting blocks are connected to the mounting bracket and spaced apart in the length direction. The crown molding is secured in the joint via connection to the mounting blocks.

According to another embodiment of the present invention, a method for installing a crown molding includes determining location of at least one wall stud related to a construction joint, determining one or more mounting locations based on the location of the at least one wall stud, mounting a framing assembly to the construction joint based on the one or more mounting locations, and attaching a crown molding to the plurality of mounting blocks.

These and other objects, aspects and advantages of the present invention will be better understood in view of the drawing and following detailed description of preferred embodiments.

DETAILED DESCRIPTION OF PREFERRED EMBODIMENTS

Figure 1:
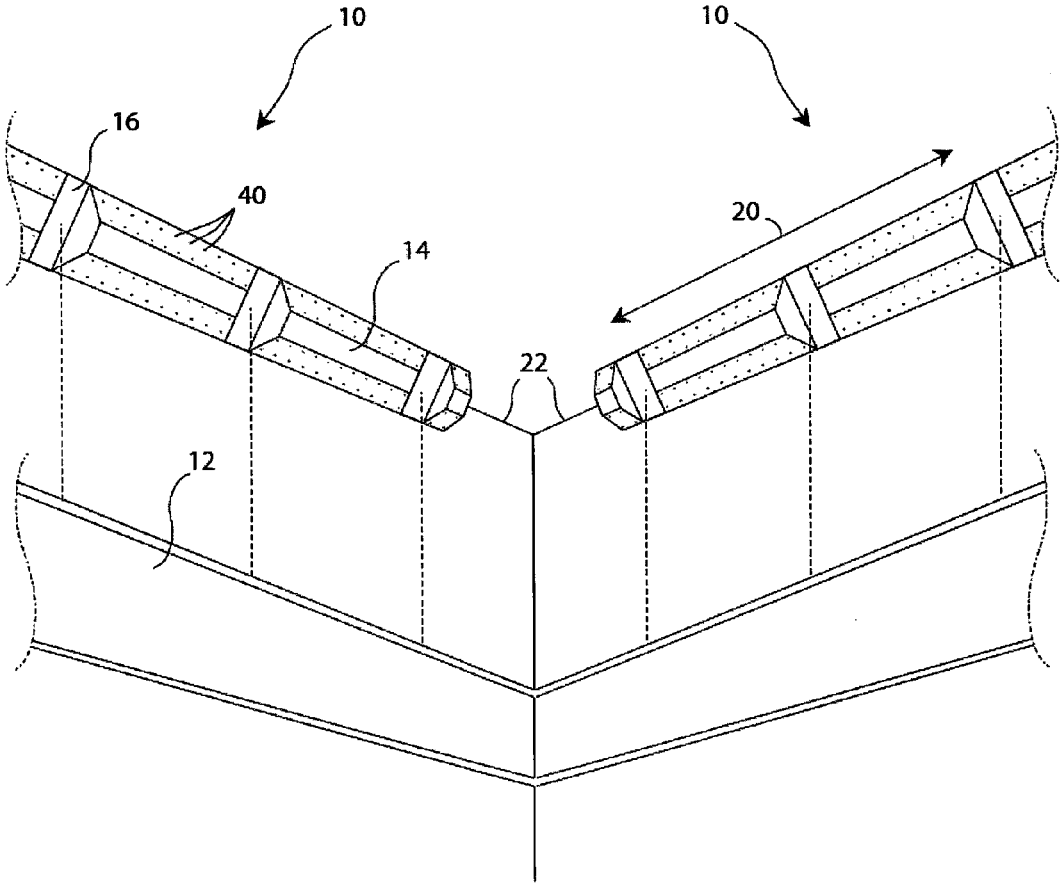
FIG. 1 is a perspective view of a crown molding framing assembly, according to an embodiment of the present invention.

According to an embodiment of the present invention, referring to FIG. 1, a framing assembly 10 (two shown in FIG. 1) for crown molding 12 includes a mounting bracket 14 and a plurality of mounting blocks 16. The mounting bracket 14 is elongated in a length direction 20 and adapted for mounting in a construction joint 22 (such as a wall-ceiling joint, as seen in FIG. 1) with the length direction 20 extending in parallel with the joint 22 axis. The mounting blocks 16 are connected to the mounting bracket 14 and spaced apart in the length direction 22. The crown molding 12 is secured in the joint 22 via connection to the mounting blocks 16.

Figure 2:
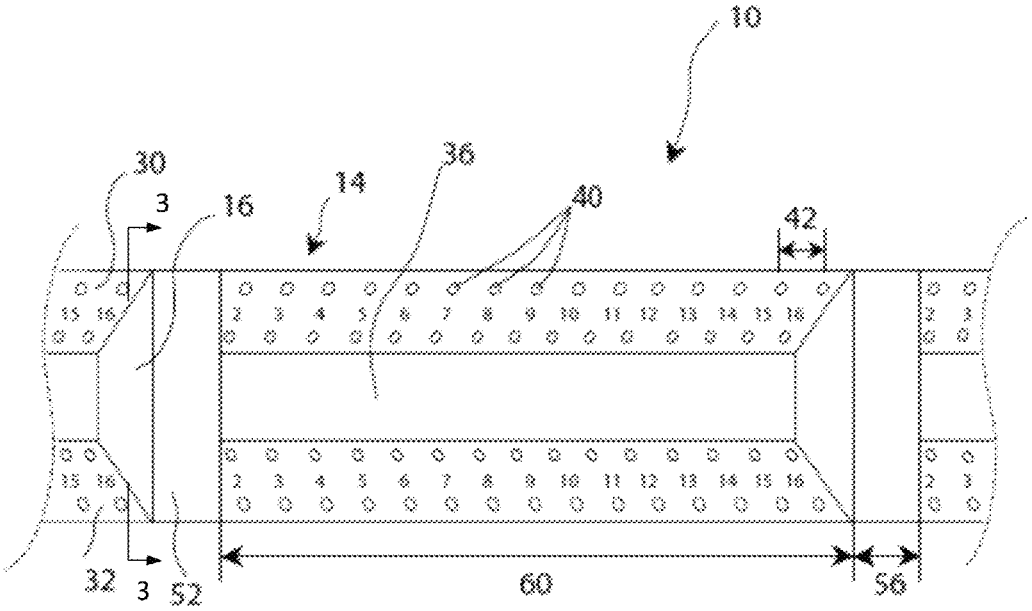
FIG. 2 is a partial perspective view of the mounting assembly of FIG. 1.
Figure 3:
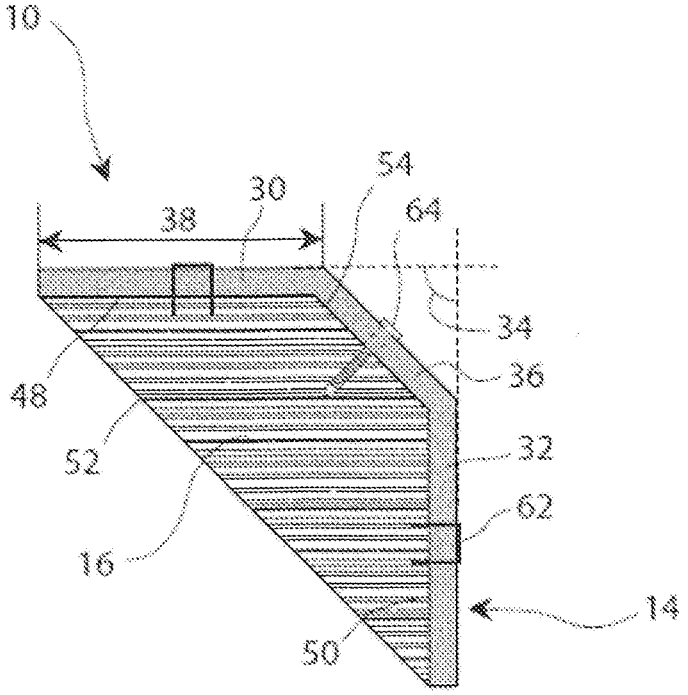
FIG. 3 is a sectional view taken along line 3-3 of FIG. 2.

Referring to FIGS. 2 and 3, the mounting bracket 14 has first and second mounting surfaces 30, 32, separated by a joint angle 34 equal to the angle of the joint 22 (see FIG. 1—typically 90 degrees). The first and second mounting surfaces 30, 32 could be directly connected, or advantageously connected by an intermediate surface 36 such that an apex of the joint angle 34 is truncated. The truncated apex provides space between the intermediate surface 36 and the joint 22 to accommodate any surface irregularities extending from the joint 22. Preferably, the first and second mounting surfaces 30, 32 have equal widths 38 traverse to the length direction 20, although other configurations are possible.

To facilitate securing the joint 22, the mounting bracket 14 defines a plurality of mounting holes 40, through which connectors can be inserted into the ceiling and wall on either side of the joint 22. Most preferably, there are two parallel lines of mounting holes 40 defined in each of the first and second mounting surfaces 30, 32. Advantageously, the holes 40 in each line are uniformly spaced apart at a predetermined interval 42 along the first and second mounting surfaces 30, 32 across the entire length direction 20. For use in the United States, a predetermined interval 42 of one inch is preferred.

Additionally, the cumulative interval between mounting blocks 16 can be stamped, printed or otherwise marked on the mounting surfaces 30, 32. The cumulative interval preferably restarts at an expected spacing between construction elements, such as studs and/or joists, encountered in the joint 22. For example, if typical wall stud spacing is 16 inches on center, the cumulative interval would restart every 16 inches. Once a single stud was located, the marked intervals could be used to readily identify the location of adjacent studs. While the mounting holes 40 thus described are advantageous, it will nonetheless be appreciated that many benefits of the present invention can be realized by a framing assembly without preformed holes 40 and/or interval markings.

The mounting bracket 14 can be made any desired total length in the length direction 20, although between 6 to 10 feet long is preferred, with 8 feet being most preferred. In installations where a shorter length of mounting assembly 10 is required, the bracket 14 can be cut by the user in situ. To this end, the mounting bracket 14 is preferably made out of a relatively light gauge sheet metal or plastic, so as to allow cutting using tools available to the typical craftsperson. The combination of the mounting bracket 14 with the mounting blocks 16 results in a greater rigidity for the combined structure, while allowing a reduced weight and amount of material overall.

The mounting blocks 16 are connected to the mounting bracket 14 in the joint angle 34, with first and second sides 48, 50 preferably abutting both the first and second mounting surfaces 30, 32, respectively. A mounting surface 52 is flat and extends between the first and second sides 48, 50. To accommodate the intermediate surface 36, the mounting block 16 has a third side 54, giving the block 16 when viewed in the length direction 20. In a mounting bracket 14 without the intermediate surface 36 a triangular block could be used, or an inner portion could still be omitted to conserve weight.

The mounting blocks 16 preferably have a uniform width 56, such as one inch, and uniform spacing 60 therebetween in the length direction. The uniform spacing 60 can vary, but 12 to 24 inches is preferred with 16 inches being most preferred. The mounting blocks 16 are made out of a material to which the crown molding can be readily attached using conventional means (such as nails). Wood of a similar density to framing studs is accordingly preferred.

Referring more particularly to FIG. 3, the mounting block 16 can be attached to the mounting bracket 14 via any sufficiently durable means. Staples or other fasteners 62 inserted through the first and second mounting surfaces 30, 32 can be used. For brackets 14 with an intermediate surface 36, a fastener 64 such as a screw can be used. The truncated angle vacated by use of the intermediate surface 36 is further advantageous in this case, in that interference between any exposed portion of the fastener 64 and the joint 22 is avoided.

In the depicted embodiment, the mounting block 16 is a truncated isosceles triangle, such that approximately equal 45 degree angles are formed between edges of the block and the wall/ceiling on either side of the joint 22. This geometry is particularly suited to 45/45 crown molding; however, it will be appreciated that the block 16 and mounting bracket 14 dimensions can be varied to accommodate other crown molding types. For instance, the present invention could be readily adapted to 52/38 crown molding.

Figure 4:
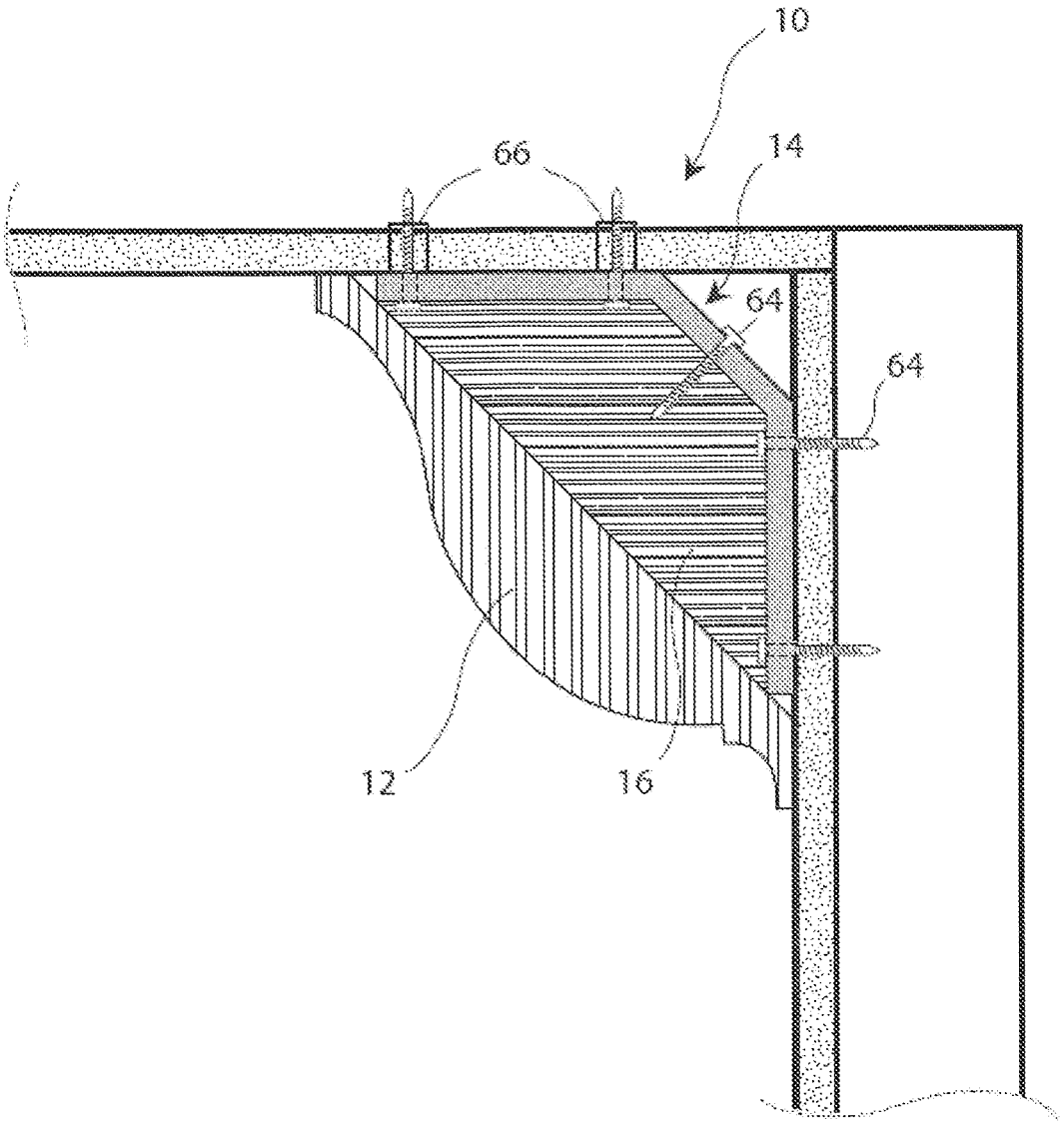
FIG. 4 is a sectional view of the mounting assembly of FIG. 1, with crown molding secured thereto.

Referring to FIGS. 1 and 4, during use of the framing assembly 10, the location of at least one wall stud is determined. The framing assembly 10 is placed in the joint 22, and the mounting bracket 14 is temporarily tacked to the stud of determined location and to one or more additional studs, which can be readily located using the marked mounting holes 40, or markings without preformed holes. The desired locations for ceiling mounting are then marked (through the mounting holes 40, if present) and the framing assembly 10 is removed, if it is necessary to install ceiling anchors 66 for proper holding. After anchors 66 are installed, the framing assembly 10 is replaced and permanently mounted. Permanent mounting can be effected by any suitable fasteners, including screws. Finally, the crown molding 12 can simply and easily be attached to the mounting blocks 16; for instance, by nailing or the like. It will be appreciated that not all of the foregoing steps would be used for every installation, and that the number, type and configuration of fasteners is readily adaptable to the demands of a given installation.

Figure 5:
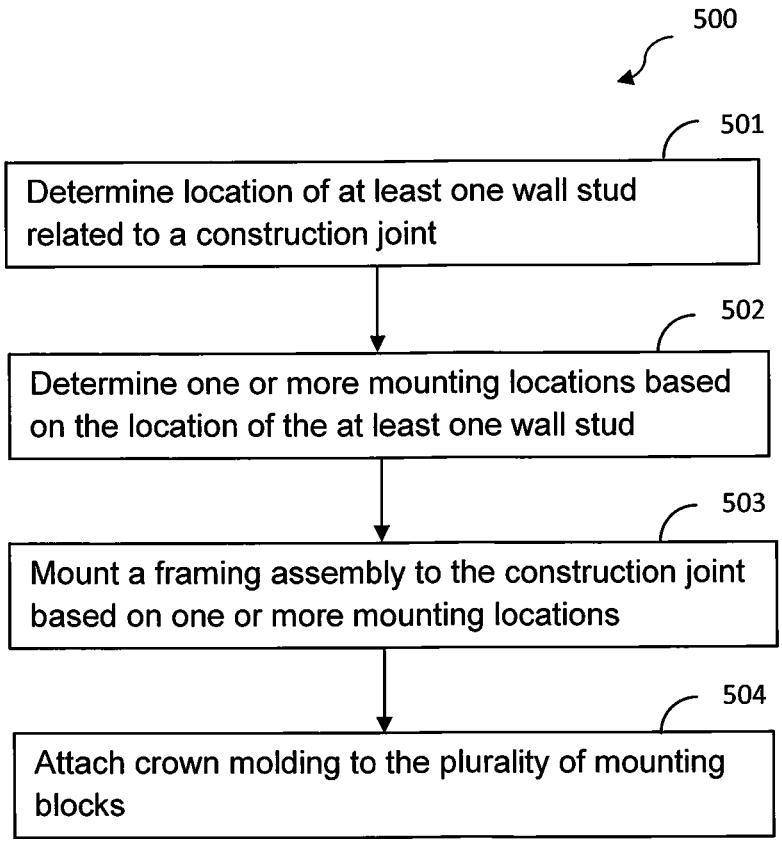
FIG. 5 is a flowchart illustrating an example method of installing a crown molding according to an embodiment of the present invention.

FIG. 5 is a flowchart illustrating an example method 500 for mounting a crown molding.

At step 501, location of at least one wall stud related to a construction joint is determined. For example, the location of at least one wall stud related to joint 22 is determined by a metal detector to detect metal objects, such as screws, nails, tacks or the like, in the wall.

At step 502, one or more mounting locations is determined based on the location of the at least one wall stud. For example, determining one or more framing assembly mounting locations includes determining one or more additional wall studs using one or more markers (e.g., stamps, printed marks, mounting holes 40) on the mounting bracket 14 of the framing assembly 10. The framing assembly 10 is placed in the joint 22, and the mounting bracket 14 is use to locate one or more additional wall studs based on the location of the at least one wall stud determined at step 501 and uniform intervals (e.g., one inch) between one or more marks on the mounting bracket 14.

At step 503, a framing assembly is mounted to the construction joint. The mounting can be affected by any suitable fasteners 64 such as screws, nails, and the like. For example, the mounting bracket 14 can be attached to the joint 22 by inserting connectors (e.g., nails) through a plurality of mounting holes 40 along the first and second mounting surface 30 and 32 into both sides of the joint 22. Prior to mounting the framing assembly to the construction joint, one or more ceiling anchors 66 can be temporarily installed for holding the determined one or more mounting locations.

At step 504, a crown molding is attached to the plurality of mounting blocks. The crown molding 12 can simply and easily be attached to a plurality of mounting blocks 16; preferably by nailing, although adhesives or other attachment means could be employed.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A crown molding framing assembly comprising:

a mounting bracket for mounting in a construction joint; and a plurality of mounting blocks attached to the mounting bracket;

wherein the mounting bracket has a first mounting surface and a second mounting surface connected by an intermediate surface, such that an apex of an angle between the first and second mounting surfaces is truncated;

wherein each of the plurality of mounting blocks contacts the first mounting surface, the second mounting surface, and the intermediate surface; and wherein the plurality of mounting blocks are spaced apart in a length direction of the mounting bracket.

2. The frame assembly of claim 1, wherein the mounting bracket is elongated in a length direction parallel to the construction joint.

3. The frame assembly of claim 1, further comprising crown molding attached to the plurality of mounting blocks.

4. The frame assembly of claim 1, wherein the first mounting surface and the second mounting surface are separated by a joint angle equal to the angle of the construction joint.

5. The frame assembly of claim 1, wherein the mounting bracket comprises a plurality of mounting marks to facilitate attaching the mounting bracket to the construction joint.

6. The frame assembly of claim 5, wherein the mounting marks comprise at least one of: tamps, printed marks, and holes.

7. The frame assembly of claim 1, wherein the mounting block is a truncated triangular shape.

8. The frame assembly of claim 1, wherein opposite sides of the mounting block each form a 45 degree angle with a respective side of the construction joint.

9. The frame assembly of claim 1, wherein opposite sides of the mounting block respectively form 52 and 38 degree angles with respective sides of the construction joint.

10. A method for installing crown molding comprising:

determining location of at least one wall stud related to a construction joint;

determining one or more mounting locations based on the location of the at least one wall stud;

mounting a framing assembly to the construction joint based on the one or more mounting locations, wherein the framing assembly comprises a mounting bracket and a plurality of mounting blocks attached to the mounting bracket prior to mounting, the plurality of mounting blocks being spaced apart in a length direction of the mounting bracket; and attaching the crown molding to the plurality of mounting blocks;

wherein the mounting bracket of the framing assembly comprises a first mounting surface and a second mounting surface separated by a joint angle equal to the angle of the construction joint; and wherein the first mounting surface and the second mounting surface are connected by an intermediate surface such that an apex of an angle between the first and second mounting surfaces is truncated.

11. The method of claim 10, wherein determining one or more framing assembly mounting locations comprises measuring locations of one or more additional wall studs with one or more markers on the mounting bracket based on the location of the at least one wall stud.

12. The method of claim 11, wherein the one or more markers comprise at least one of: stamps, printed marks, and holes.

13. The method of claim 11, wherein the one or more markers include at least two markers uniformly spaced apart at a predetermined interval.

14. The method of claim 10, wherein the mounting block is a truncated triangular shape.

15. The method of claim 10, wherein determining one or more mounting locations comprises installing one or more fasteners for temporarily mounting the framing assembly to the construction joint.

16. The method of claim 15, further comprising removing the framing assembly from the construction joint and installing one or more anchors at the determined one or more mounting locations.

17. The method of claim 16, wherein mounting a framing assembly to the construction joint based on the one or more mounting locations comprises reinstalling the framing assembly after the temporary mounting and removal.

18. The method of claim 10, wherein each of the plurality of mounting blocks contacts the first mounting surface, the second mounting surface, and the intermediate surface.

* * * * *